US009706897B2

(12) United States Patent
Van Tol et al.

(10) Patent No.: US 9,706,897 B2
(45) Date of Patent: Jul. 18, 2017

(54) PERSONALIZED CLEANING COMPOSITION DISPENSING DEVICE

(71) Applicant: The Procter & Gamble Company, Cincinnati, OH (US)

(72) Inventors: Mik Van Tol, Zuid-Holland (NL); Robby Renilde Francois Keuleers, Lippelo (BE); Paulus Antonius Augistinus Hoefte, Astene (BE); Benjamin Niestroj, Königstein Im Taunus (DE)

(73) Assignee: The Procter & Gamble Company, Cincinnati, OH (US)

( * ) Notice: Subject to any disclaimer, the term of this patent is extended or adjusted under 35 U.S.C. 154(b) by 329 days.

(21) Appl. No.: 14/548,651

(22) Filed: Nov. 20, 2014

(65) Prior Publication Data

US 2016/0143505 A1 May 26, 2016

(51) Int. Cl.
*A47L 15/44* (2006.01)

(52) U.S. Cl.
CPC ..... *A47L 15/449* (2013.01); *A47L 15/4409* (2013.01); *A47L 15/4445* (2013.01);
(Continued)

(58) Field of Classification Search
CPC ..... A47L 15/4463; A47L 15/4472; A47L 15/4445; D06F 39/02; D06F 39/024
USPC ..... 68/17 R, 12.18, 207, 12.02, 12.01, 213, 68/235 R, 12.23; 222/1, 52, 23, 651, 129, 222/504, 144.5, 63, 71; 134/93, 56 D, 134/18, 25.2, 57 D, 113, 56 R, 58 D, 134/99.2, 115 R, 94.1, 26, 57 R
See application file for complete search history.

(56) References Cited

U.S. PATENT DOCUMENTS 5,160,654 A 11/1992 Falou et al.
6,736,294 B2 * 5/2004 Smith ..... D06F 39/024 222/463
(Continued)

FOREIGN PATENT DOCUMENTS

DE 31 12 515 A1 12/1982
DE 20 2006 019818 U1 4/2007
(Continued)

OTHER PUBLICATIONS

International Search Report; International Application No. PCT/US2015/060493; date of mailing Feb. 12, 2016; 11 pages.
(Continued)

*Primary Examiner* — David Cormier
*Assistant Examiner* — Thomas Bucci
(74) *Attorney, Agent, or Firm* — John T. Dipre; Steven W. Miller

(57) ABSTRACT

A personalized cleaning composition dispensing device for use in an automatic dishwasher dispensing the right chemistry at the right time during a wash cycle to provide an improved cleaning performance compared to standard automatic dishwasher dispensers. The device includes wash cycle sensing system that controls the release of chemistry via temperature and water flow data measured during the current wash cycle and uses either a preprogrammed product release algorithm for new wash cycles or a modified product release algorithm based on wash cycle data previously stored in the data storage unit for repeated wash cycles.

12 Claims, 10 Drawing Sheets

(52) U.S. Cl.
CPC ..... *A47L 15/4463* (2013.01); *A47L 15/4472* (2013.01); *A47L 2401/03* (2013.01); *A47L 2401/06* (2013.01); *A47L 2401/10* (2013.01); *A47L 2401/11* (2013.01); *A47L 2401/12* (2013.01); *A47L 2401/14* (2013.01); *A47L 2401/30* (2013.01); *A47L 2501/07* (2013.01)

(56) References Cited

U.S. PATENT DOCUMENTS

| | | | | |
|---|---|---|---|---|
| 6,958,693 | B2 * | 10/2005 | Rothgeb | A47L 15/4297 134/113 |
| 7,150,284 | B2 * | 12/2006 | Aulbers | A47L 15/006 134/113 |
| 8,221,696 | B2 * | 7/2012 | Brandt | A47L 15/4463 422/261 |
| 8,631,972 | B2 | 1/2014 | Kessler et al. | |
| 8,651,336 | B2 * | 2/2014 | Gadini | A47L 15/4454 134/115 R |
| 2002/0086806 | A1 | 7/2002 | Giblin et al. | |
| 2002/0088502 | A1 * | 7/2002 | Van Rompuy | A47L 15/006 141/1 |
| 2003/0182732 | A1 * | 10/2003 | Davenet | A47L 15/4454 8/158 |
| 2003/0227394 | A1 * | 12/2003 | Rothgeb | A47L 15/4297 340/870.01 |
| 2005/0022314 | A1 | 2/2005 | Ambuter et al. | |
| 2006/0179583 | A1 | 8/2006 | Ambuter et al. | |
| 2006/0243630 | A1 | 11/2006 | Bourgoin et al. | |
| 2008/0276966 | A1 | 11/2008 | Yusuf et al. | |
| 2009/0104093 | A1 * | 4/2009 | Brandt | A47L 15/4472 422/261 |
| 2010/0167974 | A1 | 7/2010 | Wiedemann et al. | |
| 2011/0087367 | A1 | 4/2011 | Gadini et al. | |
| 2011/0139818 | A1 | 6/2011 | Kessler et al. | |
| 2011/0189413 | A1 | 8/2011 | Denome et al. | |
| 2012/0159904 | A1 | 6/2012 | Catlin et al. | |
| 2013/0036772 | A1 | 2/2013 | Brueckner et al. | |
| 2014/0130831 | A1 | 5/2014 | Benda et al. | |
| 2014/0299502 | A1 | 10/2014 | Krubasik et al. | |
| 2015/0119311 | A1 | 4/2015 | Catlin et al. | |
| 2016/0143506 | A1 | 5/2016 | Van Tol et al. | |
| 2016/0145548 | A1 | 5/2016 | Van Tol et al. | |

FOREIGN PATENT DOCUMENTS

| | | | |
|---|---|---|---|
| DE | 10 2007 042863 | A1 | 3/2009 |
| EP | 1 088 927 | A1 | 4/2001 |
| WO | WO 2010/007051 | A2 | 1/2010 |

OTHER PUBLICATIONS

International Search Report; International Application No. PCT/US2015/060496; date of mailing Feb. 15, 2016; 6 pages.
International Search Report; International Application No. PCT/US2015/060497; date of mailing Feb. 4, 2016; 11 pages.
U.S. Appl. No. 14/548,660, filed Nov. 20, 2014, Mik Van Tol, et al.
U.S. Appl. No. 14/548,675, filed Nov. 20, 2014, Mik Van Tol, et al.

* cited by examiner

PERSONALIZED CLEANING COMPOSITION DISPENSING DEVICE

FIELD OF THE INVENTION

The present invention relates to a cleaning composition dispensing device for a dishwasher. Particularly, a personalized cleaning composition dispensing device is provided which is tailored to a consumer's automatic dishwasher and corresponding dishwashing behavior.

BACKGROUND OF THE INVENTION

The automatic dishwasher, or ADW, has become a part of today's society. More and more households own one and therefore, the products that are used with them are evolving quickly. First there was a need to add a main wash cleaning composition in powder form, rinse aid and salt for a wash program. Next, the main wash cleaning composition evolved from loose powder into a compressed powder tablet to simplify dosing the right amount powder. Additional rinse aids and salt were still needed; however, it did not take long before all-in-one tablet solutions were available on the market.

Despite the fact that most of the practical aspects of cleaning results have been improved, there are still performance issues with the ADW. For instance, consumers have accepted that rinsing, and soaking dishes prior to loading dishes in the ADW is needed to make sure the dishwasher can completely clean the dishes. In addition, spotted glasses and the need for towel drying dishes are almost accepted flaws of the automatic dishwasher. Therefore, there is a need to find a solution that eliminates these compensatory behaviors and enables a consumer to get the most out of the automatic dishwasher's performance capabilities.

Research has shown that the main reason these problems exist is that all cleaning compositions in the tablet are released at the same time. Some cleaning compositions counteract or are not fully compatible with each other, leaving the full potential cleaning performance unmet Thus, a dispensing device is desired that can sequentially release cleaning compositions at defined times during the wash program that can increase the cleaning performance of the automatic dishwasher.

Wash programs for ADWs can contain five different cycles: pre-wash, main wash, rinse cycle, dry cycle and purge cycle. The different wash cycles occur in the order of pre-wash, main wash, and rinse cycle. The water is typically refreshed between each wash cycle (e.g. Pre-wash or Main wash cycle). Not all wash programs contain all cycles and it is possible that some cycles could occur twice or even three times. Thus, a dispensing device for releasing cleaning agents in an automatic dishwasher needs to be capable of sensing the wash cycles. Wash cycles may be distinguished by water temperature; however, determining which cycles are heated and which cycles are not depends on the dishwasher brand and model. In general the main wash and final rinse cycles are heated for improved cleaning performance; however, prewash cycles can be heated or cold.

An overview wash cycle programs based on several machines currently in the market illustrates the diversity of ADW wash cycles.

| | |
|---|---|
| Pre-wash | |
| Occur # times in wash program: | not at all, 1 - 2 or even 3 times Heated: depends on wash cycle |
| Temperature range: | 5 - 50° C. |
| Duration: | 4 - 25 minutes |
| Main wash | |
| Occur # times in wash program: | Once/always in wash program Heated: Yes, always |
| Temperature range: | 37 - 75° C. |
| Duration: | 16 - 85 minutes |
| Rinse cycle | |
| Occur # times in wash program: | 1- 2 or 3 times |
| Heated: | depends on wash cycle |
| Temperature range: | 5 - 75° C. |
| Duration: | 3 - 47 minutes |
| Dry cycle | |
| Occur # times in wash program: | Once in wash program |
| Heated: | depends on ADW model |
| Temperature range: | 72° C. to room temperature (20° C.) |
| Duration: | till user opens ADW door |

As shown, the temperature and duration values between pre-wash and main wash cycles often overlap making it difficult to distinguish between these cycles.

A majority of dishwashers today feature a minimum of three wash programs; however, models exist with up to fifteen wash programs. The different wash programs having different cycle times and temperature profiles emphasizes the significance of correctly sensing the wash program and corresponding wash cycles for the sequential release of cleaning agents. It has been determined that ultimate cleaning performance can be achieved by releasing one cleaning composition during the pre-wash cycle, two preferably three cleaning compositions during the main wash cycle and one cleaning composition during the rinse cycle.

The challenge for wash program sensing is determining what parameters to measure in order to clearly distinguish between the wash cycles. For instance, wash cycle parameters such as temperature, water flow and cycle duration (time) can be measured and used to automatically trigger the release of cleaning agents during the wash program. Other parameters include pH value, conductivity, turbidity and motion.

Temperature

With temperature you can follow the progress of heated and cold cycles; however, the warm water inlet in North America vs. the cold inlet in Europe as well as overlapping temperature profiles of different cycles can present a problem.

Time (Duration)

Very diverse time values exist for the different wash programs. For instance, pre-washes range from single prewash cycles of 7 minute duration to double prewash cycles with each prewash cycle having duration of 3 to 5 minutes. Main wash cycles can vary from 30 minutes to 75 minutes.

Water Flow

Water flow sensors can be used to detect water flow similar to sensors used to detect water droplets on windshields of cars having automatic wipers.

pH Value

The pH value of the water will change when cleaning compositions are released. It is possible to use a pH sensor to recognize cycle transitions for instance if prewash cycle has a high pH level when prewash cleaning compositions are released, there will be a big drop in the pH level once the water is drained and replenished for the main wash cycle. This can indicate a cycle transition.

Conductivity

Conductivity works similar to the pH level option. The conductivity value depends on which amount, and of which chemicals are already released. However, it will not distinguish a pre-wash cycle from a main wash cycle.

Turbidity

Turbidity is already used in modern ADW's for sensing how dirty the dishes are. This can be used to determine cycle transition when water is refreshed between cycles. However, it may be easier to detect water flow instead.

Accelerometer (Motion Sensor)

The only parts of an automatic dishwasher that will move during the wash program are the spray arms. The rotation could be sensed with an accelerometer however this requires attaching a sensor to the spray arms. Since rotation of the spray arms is typically controlled by water flow, the added weight of a sensor could affect performance.

Another option is to sense the movement in front of the water intake with a motion sensor, so the sensor will know when the tub is filled (start of wash program and during cycle changes). However, the placement of the sensor will be essential and not preferred to be left to the consumer. Alternatively, a motion sensor could be connected to the dosing chamber door that opens during the main wash cycle. This approach has similar drawbacks in that it relies on the consumer to close the dosing chamber door even though cleaning composition is not placed inside.

Hall Sensor (Magnetic Field Sensor)

Magnetic fields exist during operation of the dishwasher that are registerable. Such magnetic fields are created by solenoid valves which are mainly used for opening the dosing chamber and for the water intake. However, these are so weak that you would have to place the sensor very close to the source (e.g. 10 cm). In addition, not all ADW's use solenoid valves.

Opening of Dosing Chamber

The dosing chamber containing the ADW cleaning composition always opens in the main wash providing a good indication point. A magnet may be stuck on the dosing chamber and sensed with a hall sensor to determine when it opens indicating the start of the main cycle. However, the device will have to be placed directly in front of the dosing chamber requiring placement by the consumer which is not preferred.

To conclude, most of the sensor options can be effective in detecting cycle transitions, but not so effective distinguishing cycles from one another. As discussed earlier, only the main wash cycle includes opening of the dosing chamber which distinguishes it from a pre-wash or rinse cycle. While a combination of sensors improves the ability to effectively distinguish cycles, the overlapping cycle characteristics across ADW machines makes it difficult to distinguish all cycles. For instance, it is impossible for a sensor system to predict whether a second or third hot rinse cycle will follow a first hot rinse cycle. As a result, it will automatically release all rinse compositions during the first rinse cycle, instead of during the last hot rinse cycle which is preferred. Similarly some wash cycle programs have a longer hot prewash cycle than the main wash cycle of wash cycle programs having zero pre-wash cycles causing the device to mistakenly identify the long pre-wash as a main wash and prematurely release the main wash composition during the prewash cycle.

Therefore, there is a need for a device that can release the right chemistry at the right time inside the automatic dishwasher. However, since a number of different wash programs exist within and across all dishwasher brands, the device must be capable of releasing the right chemistry at the right time consistently across all dishwasher brands and wash programs. Therefore, a dispensing device is desired that includes a wash cycle sensing system to detect wash cycle parameters such as temperature, water flow relative to time which in conjunction with an algorithm can be used to determine the preferred chemistry release points inside the dishwasher during the different phases of the wash cycle. In addition, since the cycle parameters can overlap and fluctuate between wash cycles, a recording function may be implemented to store the sensed cycle data and effectively 'learn' the wash cycles used and modify the algorithm in order to adjust the best release points based on the wash cycles chosen by the consumer. The result is a personalized cleaning composition dispensing device tailored to a consumer's dishwasher and corresponding dishwashing behavior that increases the cleaning performance of the dishwasher in such way that the compensatory behaviors are no longer needed.

SUMMARY OF THE INVENTION

The invention features, in general, a personalized cleaning composition dispensing device for an automatic dishwasher. The personalized cleaning composition dispensing device can release the right chemistry at the right time inside the dishwasher during a wash cycle to provide an improved cleaning performance compared to standard automatic dishwasher dispensers. The device includes wash cycle sensing system that provides information on the optimal moment to release the chemistry. Since every wash program is different, even between the same dishwasher brands, the dispensing device learns the wash cycle and senses the right time to release the chemistry. For this reason, the personalized cleaning composition dispensing device includes a wash cycle sensing system with temperature and water flow sensors, a data storage unit and microprocessor to determine the best release points for the chemistry inside the dishwasher. The data storage unit is implemented to store sensed data as a function of time enabling the device to 'learn' the wash cycles used by the consumer. The microprocessor controls the release of chemistry via temperature and water flow data measured during the current wash cycle and uses either a preprogrammed product release algorithm (a.k.a. preprogrammed algorithm) for new wash cycles or a modified product release algorithm (a.k.a. modified algorithm) based on wash cycle data previously stored in the data storage unit for repeated wash cycles. Temperature and water flow data measured as a function of time for new wash cycles is stored in the data storage unit.

The personalized dispensing device comprises an upper housing and a lower housing. The upper housing comprises a refill compartment and an upper electronics compartment. The lower housing comprises a dispensing compartment beneath the refill compartment and a lower electronics compartment. A power source is disposed in the upper electronics compartment. A printed circuit board (PCB) is disposed in the lower electronics compartment. The PCB comprises a microprocessor and a data storage unit linked to the microprocessor. A plurality of sensors comprising a temperature sensor and a water flow sensor are linked to the microprocessor and disposed in the lower electronics compartment beneath the microprocessor. A motor is disposed in the lower electronics compartment above the PCB. The motor is linked to the power source and the microprocessor.

A release mechanism is disposed between the upper and lower housing separating the refill compartment from the dispensing compartment. The release mechanism is mechanically connected to the motor. The microprocessor controls the motor and the corresponding chemistry release via the release mechanism using temperature and water flow data measured as a function of time during the wash cycle and either a preprogrammed product release algorithm for new wash cycles or a modified product release algorithm based on wash cycle data previously stored in the data storage unit for repeated wash cycles. Temperature and water flow data measured as a function of time for new wash cycles is stored in the data storage unit.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in conjunction with the accompanying drawings.

DETAILED DESCRIPTION OF THE INVENTION

Figure 1:
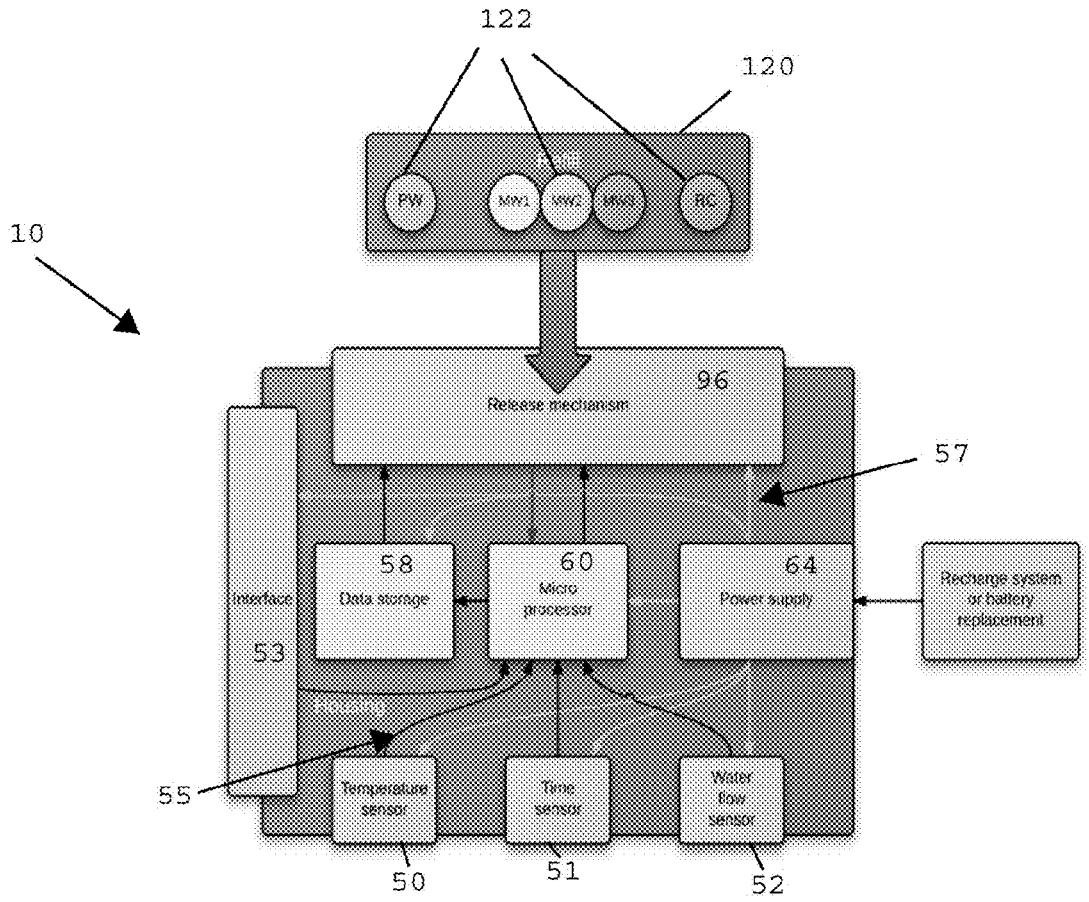
FIG. 1 is a diagram of a dispensing device in accordance with the present invention.

The personalized cleaning composition dispensing device according to the present invention is able to sense different wash cycles in a wash program, and determine the best composition release points for the consumer's ADW via a preprogrammed algorithm modified according to the recorded wash cycle data. The device can release two or more packages, preferably up to 5 packages of cleaning compositions: 1 in the pre-wash, up to 3 in the main wash and 1 in the rinse cycle. The first time the device is used it follows a preprogrammed algorithm that controls the release of the cleaning compositions and records the wash cycle data for the wash program selected. The preprogrammed algorithm is modified with the recorded wash cycle data to produce a modified algorithm. During subsequent washes using a prerecorded wash cycle program, the dispensing device selects the modified algorithm corresponding to the prerecorded wash program and releases the cleaning compositions accordingly. If a different wash program (i.e. $2^{nd}$, $3^{rd}$ wash program) is desired, the device will identify it as new via the sensed data and apply the preprogrammed algorithm while at the same time recording the wash cycle data and producing a modified algorithm for the new wash cycle program. The personalized cleaning composition dispensing device can distinguish between the different recorded wash cycle programs and apply the modified algorithm corresponding to the wash program selected by the consumer providing the best cleaning composition release points for the wash cycle program selected. The result is a self-learning device which adapts to a consumer's dishwasher behavior.

The sensor options and preprogrammed algorithm for the dispensing device were developed based on an in-depth review of different wash cycle programs of dishwashers that exist around the world. As a result, the preprogrammed algorithm enables the dispensing device to effectively dispense the cleaning compositions for most wash cycle programs. For instance, since one cleaning composition is released in the pre-wash (assuming one exists) the easiest option is to release the prewash composition 2 min after wash program has started and water flow is detected. Two minutes is based on making sure that all dishes are wet before the first release. The next three releases should then end up in the main wash. This means a cycle transition takes place which could be used as a trigger point; however, since not every wash program includes a prewash cycle, it is possible that the first pre-wash compositions will be released directly into the main wash. This can be anticipated and accounted for during the chemical design process of the cleaning composition. Nevertheless, failing to release the pre-wash cleaning composition if no pre-wash exist is not desirable since residue from the pre-wash composition could be left in the dispensing device.

Another challenge occurs when wash cycle programs have two or three pre-wash cycles making it even more difficult to distinguish the main wash from the pre-wash since it is not possible to conclude that the second cycle will always be the main wash.

One means of distinguishing a pre-wash from a main wash is by temperature, particularly where the pre-wash is a cold wash. A cold pre-wash is seldom followed by a heated pre-wash. In this case if there is a second pre-wash, it will also be a cold pre-wash. Therefore, if there is no heating registered at the start of the wash program, the cycle is a cold pre-wash, and the next heated cycle will be the main wash since the main wash is always heated. However, if the pre-wash is heated it is difficult to distinguish it from a main wash particularly since the temperature profiles and durations of the pre-wash and main wash cycles overlap. Therefore it is not possible to say e.g. when a cycle is greater than 20 minutes it will always be a main wash, or if the cycle reaches above 40° C. it will always be a main wash.

Nevertheless, a preprogrammed algorithm is provided to enable the device to best distinguish the pre-wash cycle from the main wash cycle and to recognize the rinse cycle in order to dispense the correct cleaning composition corresponding to the particular wash cycle. The preprogrammed algorithm is based on three parameters: temperature, time (duration) and water flow. It uses these parameters to identify the wash cycle and corresponding release point for the cleaning compositions dispensed. The preprogrammed algorithm was checked with several ADW wash programs to determine its effectiveness in distinguishing the different wash cycles and the release timing of the cleaning compositions to achieve the best results possible. A few of the wash cycle programs had a short working time for the third main wash cycle release, varying from only 1 to 3 minutes, which is not optimal, but determined to provide a sequential release benefit and corresponding performance increase. In addition, some of the wash programs had problems releasing the third main wash cleaning compositions because the main wash cycles were less than 22 minutes resulting in the third main wash cleaning composition being released in the rinse cycle.

A 'cycle recording function' is included in the dispensing device to compensate for the aforementioned deficiencies associated with the preprogrammed algorithm by recording the parameters measured during the wash cycles and using the measured parameters to optimize the release points for dispensing device. The recorded parameters are used in combination with the preprogrammed algorithm to produce a modified algorithm that enables the device to release the right cleaning compositions at the right time during the wash cycle. As previously explained, the first time the dispensing device is used for a particular wash program, the device follows the pre-programmed algorithm while the cycle recording function records the temperature, water flow and time measured corresponding to the wash cycle data. A modified algorithm is produced providing the optimal cleaning composition release timing based on the wash cycle data recorded for that particular wash program. During repeat uses of the dispensing device with that particular wash program, the device is able to recognize the wash program based on the recorded data and apply the modified algorithm accordingly. As a result, any loss in performance caused by non-optimal release of cleaning compositions can be overcome.

For instance, for wash programs having multiple rinse cycles, a sensor system cannot predict whether a second or third hot rinse cycle will follow a first hot rinse cycle. While the preprogrammed algorithm will cause the dispensing device to release the rinse cycle cleaning composition during the first hot rinse cycle the first time it is used for that particular wash program, it will apply the modified algorithm during repeat uses of the wash program causing the dispensing device to release the rinse composition during the last hot rinse cycle which is preferred. Similarly, some wash programs have longer hot prewash cycles than main wash cycles of wash programs with zero pre-wash cycles. As a result, the preprogrammed algorithm could identify the long pre-wash as the main wash and release the main wash composition during the prewash cycle. During subsequent uses of the dispensing device with that particular wash program, the device will apply the modified algorithm enabling it to dispense the main wash cleaning composition after the long prewash cycle has finished.

In order to get optimal cleaning results the first time the dispensing device is used for cleaning a dirty load of dishes, the device can be pre-recorded with all the wash cycle programs for a particular ADW machine by placing the dispensing device without cleaning composition in an empty ADW machine and running the machine through all the wash programs allowing the recording function to record the temperatures, water flow and duration for each of the wash cycles. As a result, the dispensing device can produce modified algorithms for each of the wash programs that can be applied the first time the dispensing device is used with a dirty load of dishes producing optimal cleaning results.

In order to simplify the chemistry of the cleaning compositions and simplify the dispensing device design, the number of cleaning composition releases can be reduced from five to three, one prewash composition, one main wash composition and one rinse composition. An ADW wash program includes zero to one pre-wash cycle, a main wash cycle, and one to three rinse cycles. Each of these wash cycles starts with filling the ADW tub with water and ends with pumping the water out of the tub. Therefore, the dispensing device preprogrammed algorithm can be made to recognize the number of wash cycles for a wash program as the period in-between water filling steps, with the final rinse cycle following the last water filling step. Deciding on what to release and when to release it, becomes a pure time based, following the following criterion:

Water is present in the ADW tub prior to any release of cleaning composition to aid in dissolution.

Regardless what wash cycle is actually running, the dispensing device will release the pre-wash cleaning composition, 2 minutes after sensing the first water inlet.

Similarly, the rinse cycle cleaning composition will be released 2 minutes after sensing the last water inlet, which by definition is the last rinse cycle.

Determining when to release the main wash cleaning composition depends on whether or not the wash program includes a prewash cycle.

For instance, if the dispensing device recognizes that the wash program has only two wash cycles, a main wash cycle and a rinse cycle, then the prewash cleaning composition will be released 2 minutes after sensing the first water inlet and the rinse cleaning composition will be released 2 minutes after sensing the second water inlet. The main wash cleaning composition needs to be released in the main wash cycle which in this case happens to be the same cycle as the pre-wash composition. The preprogrammed algorithm will cause the release of the main wash composition in the first wash cycle subsequent to the prewash composition based on water temperature and time. The main wash composition is preferably released at the midpoint of the main wash cycle in order to separate it as much as possible from the prewash cleaning composition and give both the maximum time to work. Based on recorded data for this wash program the dispensing device will produce a modified algorithm which is applied the next time the wash program is selected causing the dispensing device to dispense the main composition midway through the first cycle.

If the dispensing device recognizes that the wash program has three wash cycles, then the prewash composition is released 2 minutes after the first water inlet, the main wash composition is released 2 minutes after the second water inlet, the rinse composition is released 2 minutes after the third water inlet. In this case, the dispensing device can optimize the release points, by recognizing the different wash cycles in a wash program based on water flow, temperature, and duration.

If the dispensing device recognizes that the wash program has more than three wash cycles, then the prewash composition is released 2 minutes after the first water inlet, the rinse composition is released 2 minutes after the last water inlet, and the main wash composition will be released 2 minutes after the water inlet of the first heated cycle following the pre-wash cycle. For instance, the device will check whether the second cycle is a heated portion or a cold portion, and will only release the main wash active if the second cycle is a heated portion. Otherwise, the device will hold the main wash composition for the next heated cycle if the second cycle is a cold portion.

For instance, a first scenario multiple cycle wash program having more than two wash cycles includes a prewash cycle, a main wash cycle and multiple rinse cycles and a second scenario includes a main wash cycle and multiple rinse cycles but no pre-wash cycle. For the first scenario, upon first use the dispensing device will release the prewash cleaning composition two minutes after sensing the first water flow, the main wash composition after sensing the second water flow and the rinse composition after sensing the third water flow. In this scenario, the modified algorithm will adjust the release point of the rinse composition so that it occurs during the final rinse cycle rather than the first rinse cycle the next time the dispensing device is used for this wash program. For the second scenario, the modified algorithm will adjust the release point for the main wash composition to occur half way through the first wash cycle and the release point for the rinse composition to occur during the last rinse cycle. For wash programs having multiple rinse cycles, typically only the last one is heated. As such the first rinse cycle can be distinguished from a main wash cycle and the last rinse cycle since the main wash cycle and the last rinse cycle are heated.

Product Architecture

The product architecture for the system function of the personalized cleaning composition dispensing device 10 defined above is displayed in FIG. 1. Items which are inside the housing are internal items and include a data storage unit 58, a microprocessor 60 and a power source 64. Items which lie outside the housing framework are items with external connections including a release mechanism 96, a temperature sensor 50, a time sensor 51, a water flow sensor 52 and a user interface 53. The power supply 64 can consist of replaceable batteries or rechargeable batteries that may be recharged via induction. (Preferably, the power supply of the device can run 50 or more wash programs until it is exhausted.) The power supply attaches to all items requiring electrical power to operate via electrical connections 57. Data which flows from the sensors and user interface to the microprocessor 60, from the microprocessor 60 to the data storage unit 58 and release mechanism 96 and from the data storage unit 58 to the release mechanism 96 is designated by arrows 55. During operation of the device, the data will be processed by the microprocessor 60 into a release signal that is sent to the releasing mechanism 96. The data received by the microprocessor 60 is also stored on the data storage unit 58 which records the wash cycle data so that it can be recalled to control the release mechanism 96 when the same wash cycle is repeated.

The refill 120 is a water soluble pouch including multiple sections for the pre-wash, main wash and rinse cycles. The refill 120 is placed into the housing and secured by the release mechanism 96. An optional lid can cover the refill 120.

Figure 2:
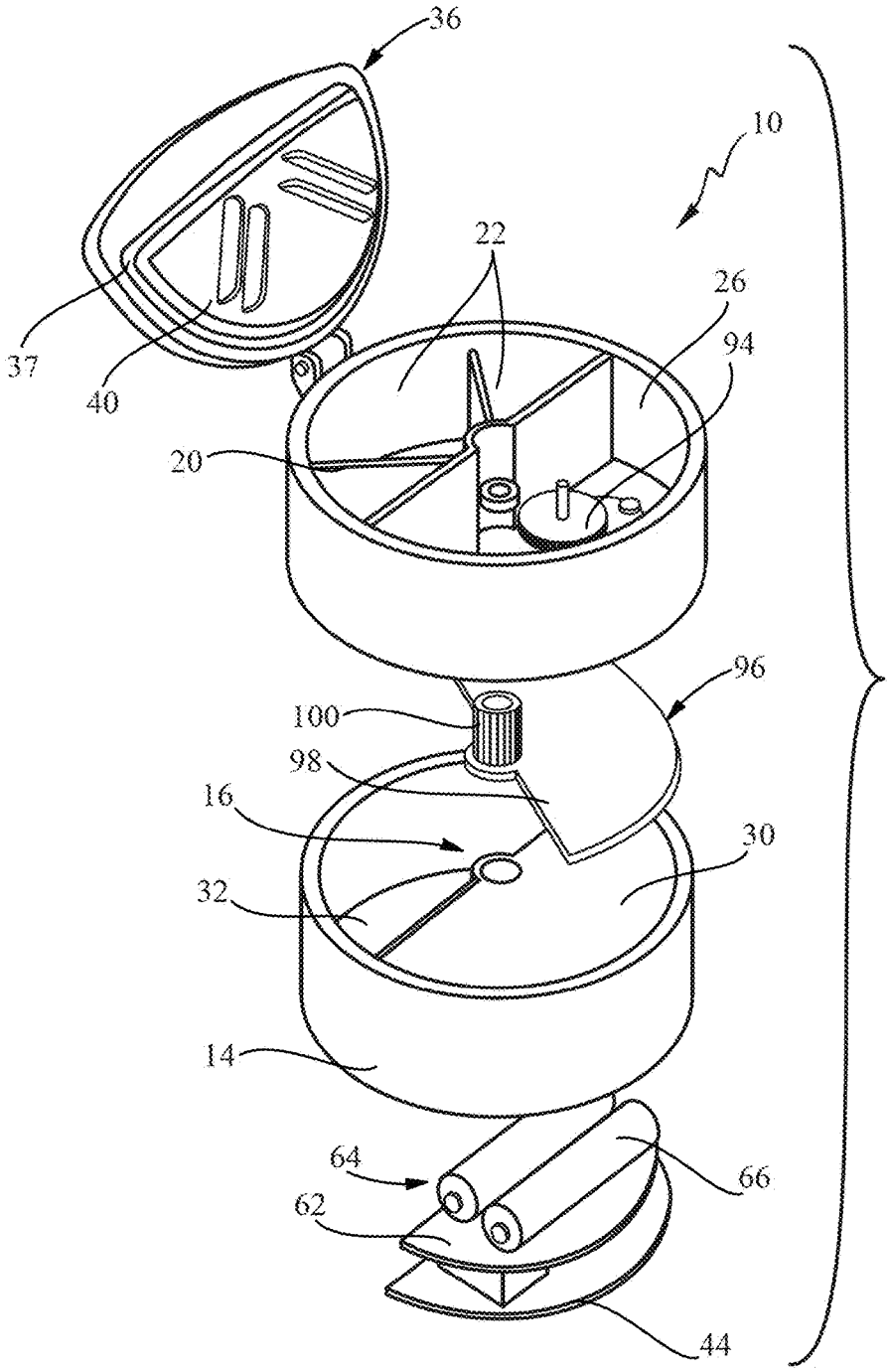
FIG. 2 is an exploded view of a dispensing device in accordance with the present invention.

In order to simplify the chemistry of the cleaning composition, reduce costs for both refill and device, and simplify the device design, the number of releases in the refill 120 can be reduced from 5 to 3. Therefore, the device can be designed with a refill compartment comprising three separate compartments instead of five providing a more compact design. An embodiment of a personalized dispensing device 10 according to the present invention is shown in FIG. 2. The device 10 is cylindrical in shape and comprises an upper housing 12 including a refill compartment 22 partitioned into three compartments for pre-packed cleaning composition pouches and an upper electrical compartment 26 for electrical components. The device includes a lower housing 14 comprising a dispensing compartment 32 beneath the refill compartment 22 and a lower electrical compartment 30. The dispensing compartment 32 is separated from the refill compartment 22 by a release mechanism 96. The release mechanism 96 can comprise a rotating disc 98 to complement the cylindrical shape of the device 10. The dispensing device 10 can include a lid hinged 36 at the back side of the upper housing 12 featuring push ribs 40 that interface with three sections of a refill (not shown) separating the refill into individual sections and forcing them into the separate compartments forming the refill compartment 22. The lid can include a gasket 37 forming a water tight seal around periphery of the refill compartment and neighboring electronics compartment 26.

A channel 16 through the middle of the device 10 provides room for wires running between the upper and lower electrical compartments 26, 30. The upper and lower electrical compartments 26, 30 include the power source 64 (i.e. batteries 66), printed circuit board (PCB), sensors and a motor. The motor includes a motor gear 94 which interfaces with a disc gear 100 on the rotating disc 98 forming the release mechanism 96. Disc rotation and corresponding pouch release is powered by the motor.

Figure 3:
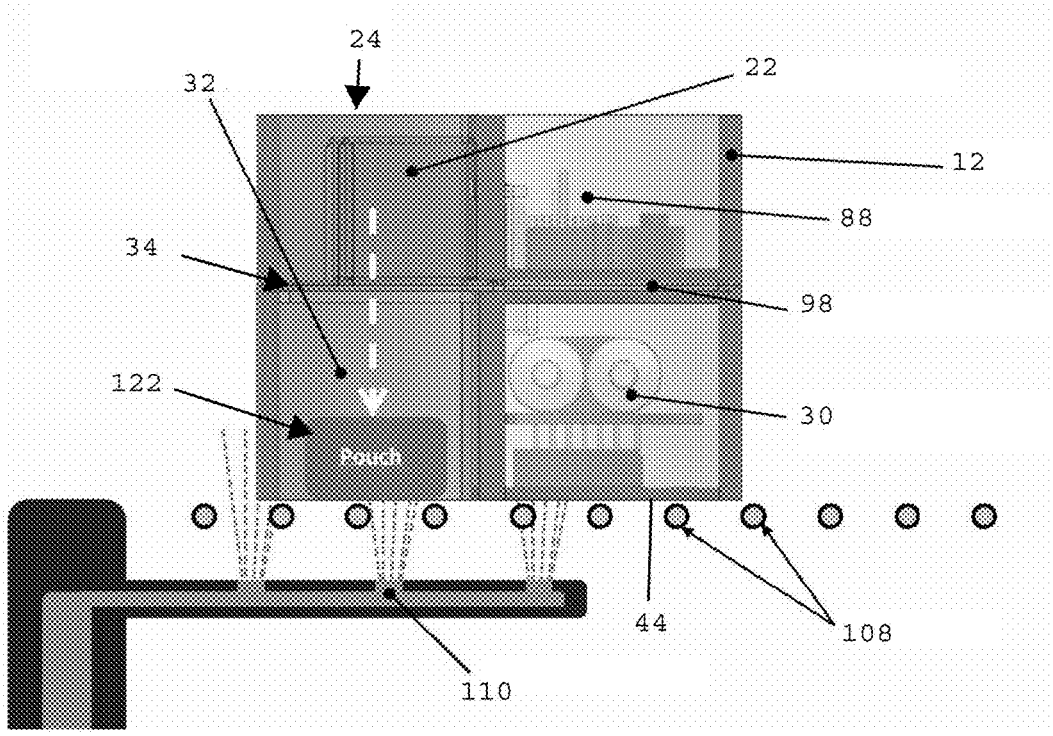
FIG. 3 is a diagram of a dispensing device in accordance with the present invention showing the operation of the device.

The dispensing compartment 32 in the lower housing 14 provides an area for dissolving the pouch 122 at a dispensing end 34 if they happen to get stuck between the ADW rack bars 108 when released from the refill compartment 22. The ADW rotating spray arm 110 will directly spray at the bottom of the pouch 122 to make sure it gets punctured as quickly as possible to make room for the next pouch released. This is illustrated in FIG. 3, showing the refill pouch 122 loaded in the refill end 24 of refill compartment 22 transcending to the dispensing end 34 of the refill compartment 22 to the dispensing compartment 32 via the release mechanism 98. During the verification test, the sections of the water soluble pouch were punctured after 26 seconds (worst case with cold water). When the pouch 122 is punctured it will empty and therefore, flatten to make room for the next pouch. The powerful direct spray from the spray arm 110 is expected to cause the pouches 122 to be punctured even quicker than 26 seconds.

Figure 4:
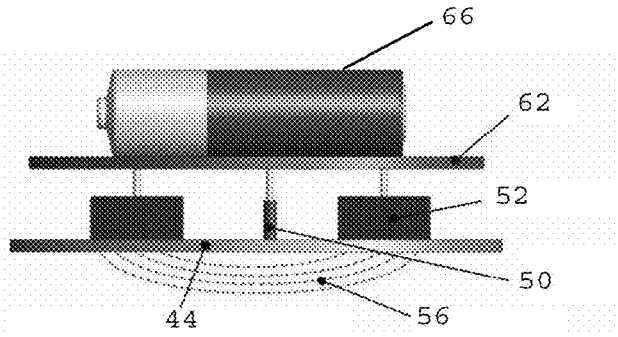
FIG. 4 is a diagram of sensors and a power source for a dispensing device in accordance with the present invention.

The dispensing device 10 previously described uses two sensors shown in FIG. 4, a temperature sensor 50 and a water flow sensor 52, both disposed in the lower housing 14. The temperature sensor 50 sticks through the bottom part 44 of the device enabling water to splash against it and measure the water temperature. The water flow sensor 52 comprises a capacity sensor 56. The capacity sensor 56 is a touch sensor which creates an electrostatic field. When an electric conductor enters the electrostatic field the sensor detects the difference in capacitance and 'senses' if conductive materials or substances such as water are near. Since water has a different conductivity than air, the capacity sensor 56 will detect water splashing against the sensor or a change in humidity in the electrostatic field. The electrostatic field is able to go through most materials; therefore, the capacity sensor 56 can be mounted inside the lower compartment and still 'sense' water splashing against the outside of the device to detect water circulation inside the ADW tub.

In the system design technical model previously described and shown in FIGS. 2 and 3, the power source 64 was located in the lower electrical compartment 30 of the device 10 and the motor was located in the upper electrical compartment 26. In an alternate embodiment illustrated in FIGS. 5 to 12, the motor and the power source have been switched to provide space for insulation of the battery compartment and to facilitate access. As a result, all the aspects of the device which require consumer interaction including the lid, refill compartment, and battery compartment are located in the upper housing.

Assembly Order

Lower Housing

Figure 5A:
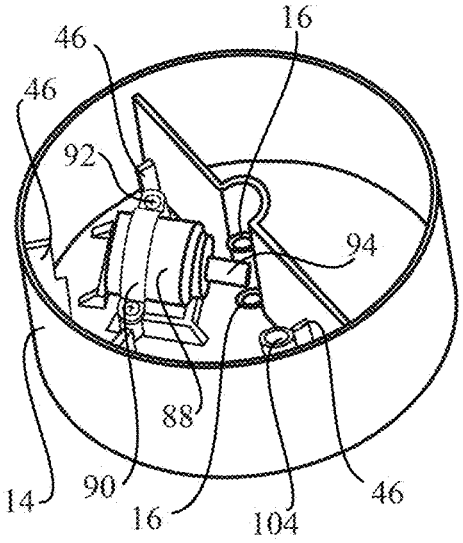
FIG. 5A and FIG. 5B are isometric views of the bottom portion of a dispensing device according to the present invention.
Figure 5B:
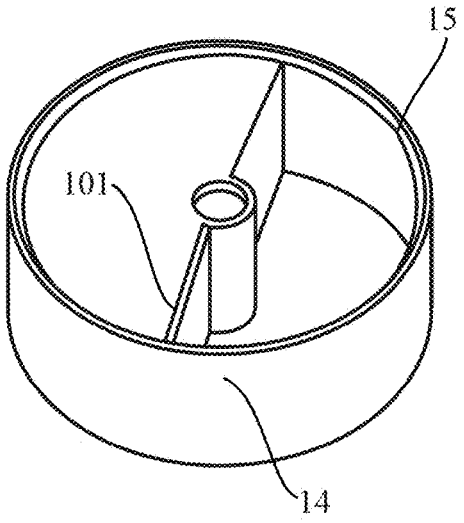
Figure 6:
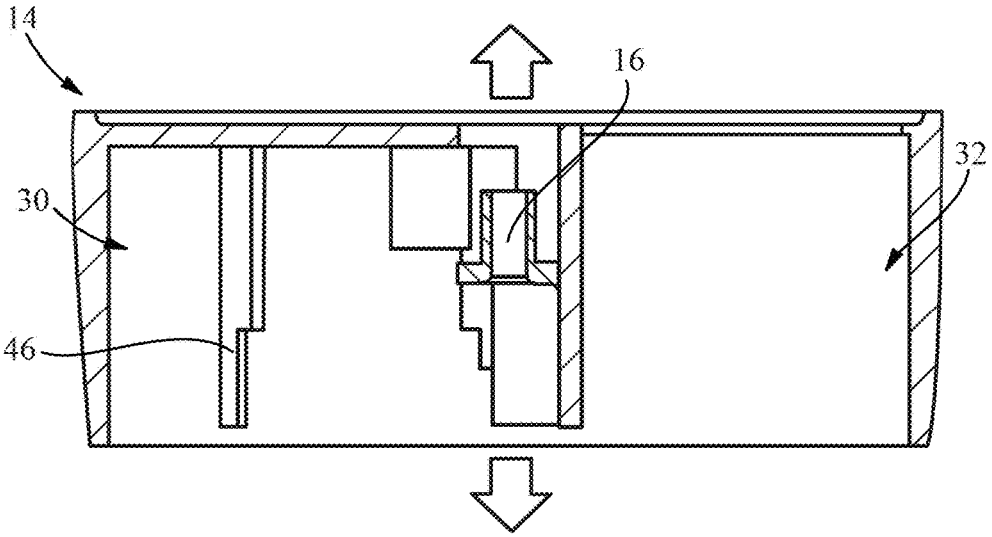
FIG. 6 is a cross sectional view of the bottom portion of the dispensing device shown in FIGS. 5A and 5B.

The lower housing 14 shown in FIGS. 5A and 5B can comprise a two component injection molded piece made from polypropylene and a thermoplastic polyolefin. FIG. 6 shows a section view of the lower housing 14. The lower housing 14 includes a wire channel 16 for the electronics in the middle of the part and a lower electronics compartment 30 in a half circle section with rib structures 46 for supporting the PCB. Opposite the lower electronics compartment 30 is a dispensing compartment 32 comprising an empty slot forming a half circle providing a space for the sections 122 of the refill 120 to dissolve in case they get stuck between the ADW rack bars as previously described.

For the embodiment shown in FIG. 5A a motor 88 is assembled in the lower housing 14. Since the motor 88 is required to accurately position the release mechanism in order to dispense the sections 122 of the refill 120, a stepper motor can be used; however, since a stepper motor is a relatively expensive motor, a DC motor is preferred. A DC motor is also smaller and can deliver higher torque than a stepper motor. The DC motor can be used in combination with a hall sensor secured relative to the lower housing 14 and a magnet disposed in the release mechanism allowing the motor 88 to precisely position the release mechanism. The lower housing 14 includes a positioning tube 104 for the hall sensor 102. The hall sensor 102 and magnet 106 on rotating disc 98 are illustrated in FIG. 9 and fully described below.

The motor 88 can be attached to the lower housing 14 via a motor mount 90 and screws 92 as shown in FIG. 5A. A motor gear comprising a worm gear 94 is attached to the motor 88 which can interface directly with a gear on the release mechanism.

Figure 7:
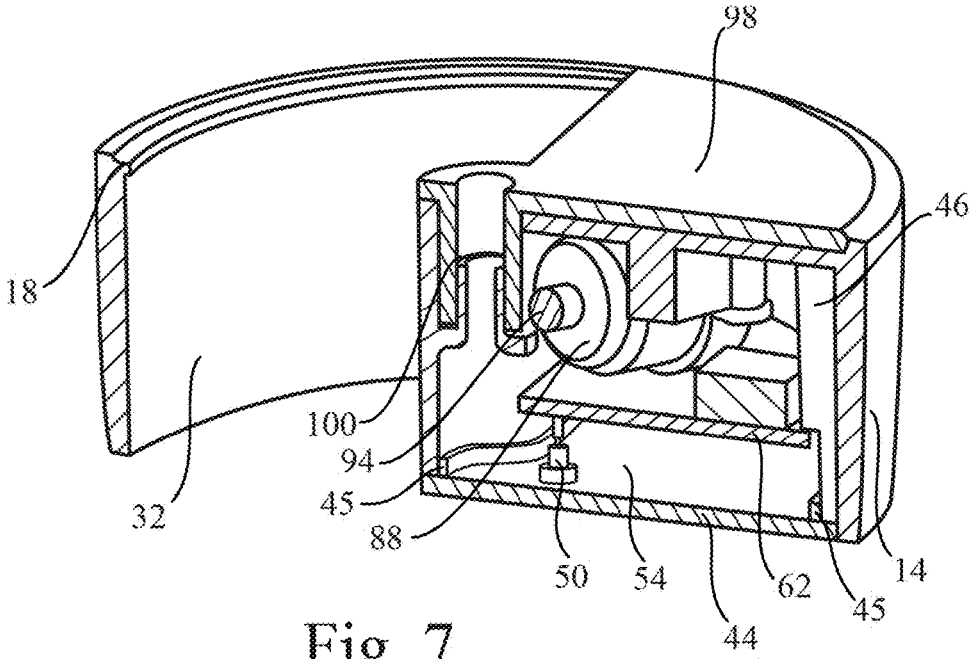
FIG. 7 is a sectional view of the bottom portion of the dispensing device shown in FIGS. 5A and 5B.

As shown in FIG. 7, the PCB 62 is positioned in the lower electronics compartment 30 of the lower housing 14 on positioning ribs 46. The components on the PCB 62 include a microprocessor 60, a data storage unit 58, a capacity sensor 52 and wire connectors 48. The wires of the motor 88 are connected to the PCB 62. As shown in FIG. 7, and FIG. 9, the lower electronics compartment 30 in the lower housing 14 is closed with a bottom part 44. A temperature sensor 50 is molded into the bottom part 44 to provide accurate temperature measurements and to decrease assembly steps. The temperature sensor 50 is connected to the PCB 62. Ribs 45 on the bottom part 44 position it for welding to the lower housing 14. A copper foil 54 is applied to the bottom part 44 to provide a sensing field for the capacity sensor 56. The copper foil 54 is held in place relative to the PCB via spacers attached to the PCB. The bottom part 44 is laser welded onto the lower housing 14 to provide a water tight seal that protects the electronics against water and humidity. In order to eliminate the need for insulation, all electronics parts can be designed to withstand up to 85° C.

Figure 9:
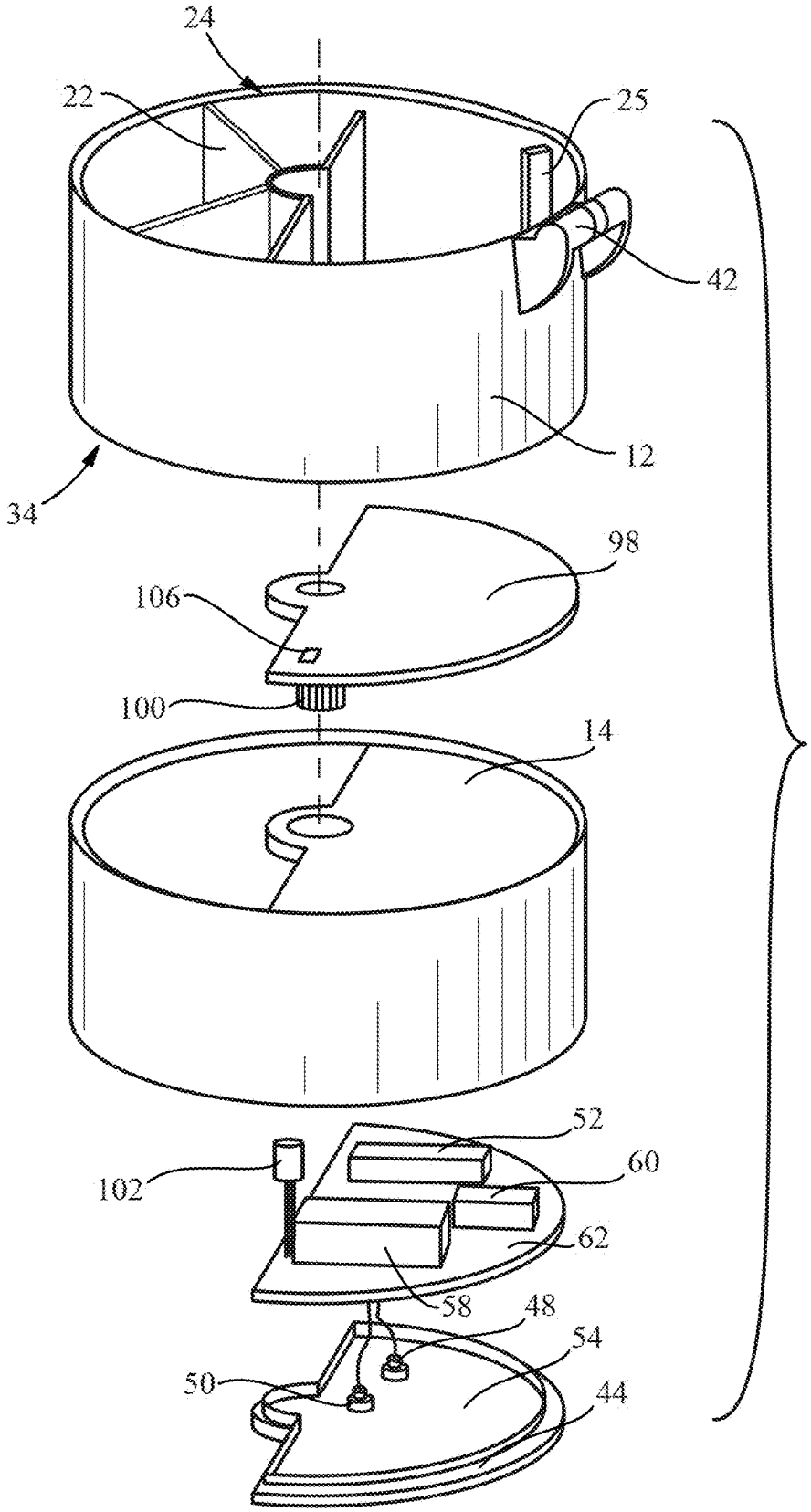
FIG. 9 is an exploded view of a dispensing device in accordance with the present invention.

The rotating disk 98 is positioned on top of the lower housing 14 as shown in FIG. 7 and FIG. 9. The rotating disk 98 can be made from polyoxymethylene (POM) which has good temperature resistance resulting in high dimensional stability for a good fit between the upper and lower housing. In addition, polyoxymethylene has self-greasing properties eliminating the need for greasing the disc gear 100 that interfaces with the motor gear 94. A magnet 106 is molded into the rotating disk 98. The hall sensor 102 in the lower housing 14 senses the magnet 106 and calculates its exact position. As a result, the DC motor 88 is able to constantly recalculate its reference point. For instance, if the device is accidentally dropped on the floor causing the motor gear to skip several gear teeth it can adjust to overcome the error.

Once the disc 98 is assembled in the lower housing 14, the upper housing 12 is laser welded to the lower housing assembly previously described forming a watertight seal. The upper housing 12 may be made from a slightly different polypropylene composition as the lower housing; however, the laser can be adjusted to such a frequency to penetrate the upper housing and melt the lower housing in order to weld the two housing pieces together.

Figure 8A:
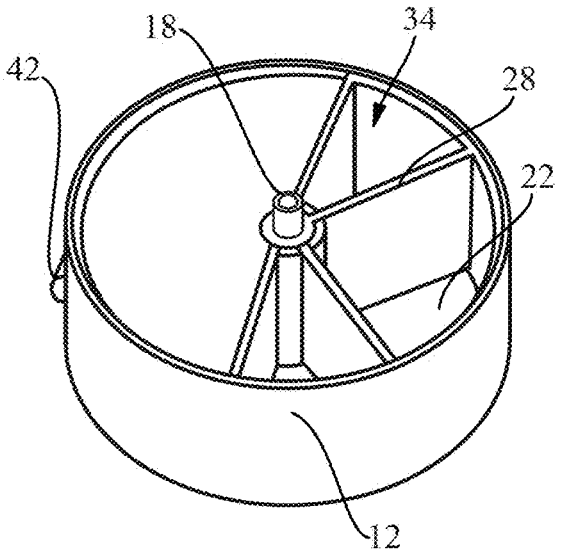
FIG. 8A and FIG. 8B are isometric views of the top portion of a dispensing device according to the present invention.
Figure 8B:
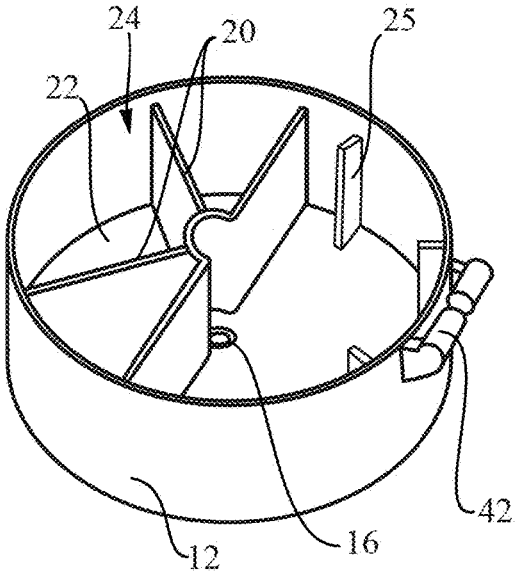

Similar to the lower housing 14, the upper housing 12 includes a wire channel 16 in the middle of the upper housing 12 as shown in FIG. 8B. A tube 18 shown in FIG. 8A positions the rotating disk 98 and protects the wires. A TPO gasket 28 on the bottom of the upper housing 12 seals the rotating disk 98 and refill compartment 22. Since the upper and lower housing 12, 14 are welded together, the disk 98 sits in between applying a constant pressure to the gasket forming a tight seal.

The Subassembly—Battery Compartment and Remaining Electronics

Figure 10A:
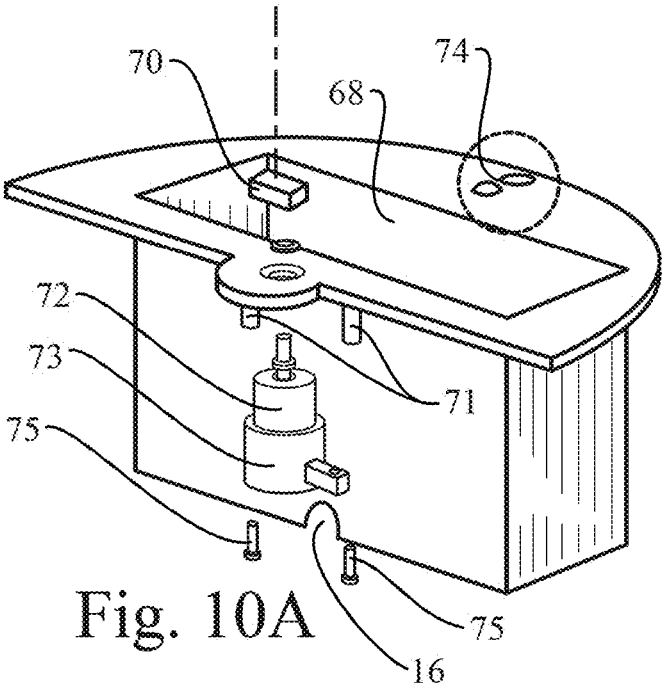
FIG. 10A is an isometric view of a component of a dispensing device according to the present invention.
Figure 10B:
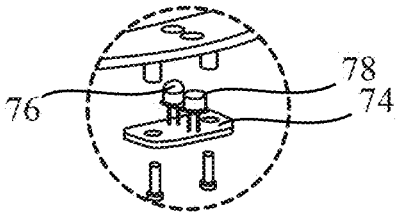
FIG. 10B is a detailed view of a portion of the component shown in FIG. 10A.

The battery compartment 68 is an injection molded part from a simple open-close mold made from polypropylene and has several molded screw sockets 71 to fasten some stock parts (FIG. 10A). At the front of the part a rotary solenoid actuator 72 is mounted with an injection molded mount 73 and two screws 75. The solenoid actuator 72 is an electromechanical actuator which is able to rotate 90 degrees when power is applied. The snap hook 70 on top of the actuator 72 interfaces with a snap hook 38 in the middle of the lid 36 shown in FIG. 12. The actuator rotates snap hook 70 and releasing it from the snap hook 38 attached to the lid 36. This same principle is used in dishwashers to open the dosing chamber and release the tablet or powder during the wash cycle. With the implementation of the solenoid actuator 72, the dispensing device is able to open the lid on its own after the wash cycle has been finished. This ensures the device will dry completely during the drying cycle of the dishwasher. In addition, the consumer will visually see the dispensing device 10 is empty and ready to be reloaded for the next run. It also makes the usage steps of the device similar to a normal dishwasher dosing chamber.

At the back of the battery compartment 68 a small PCB 74 with a LED 76 and watertight light-dependent resistor (LDR) sensor 78 can be mounted with two screws. An o-ring on the LED and LDR transparent cap will assure watertight sealing of the small PCB. The LED 76 is included to warn consumers of low battery life. To save battery life, the LDR sensor 78 is provided to measure light intensity. Since the LED does not need to blink when the consumer cannot see the LED such as when the lid of the device is closed, or when the ADW door is closed, the LDR sensor will not measure any light intensity in these conditions preventing the LED from blinking.

Figure 11:
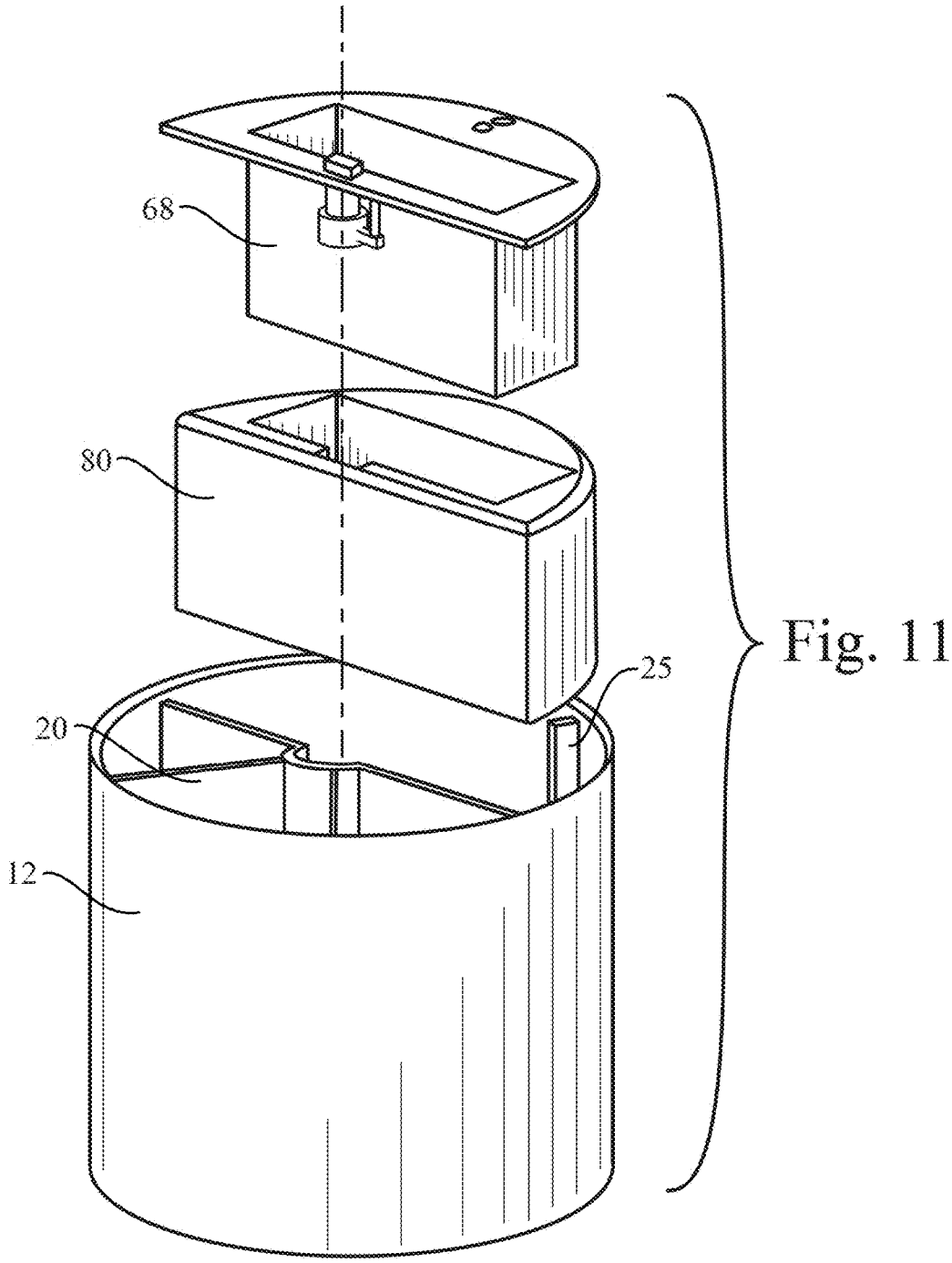
FIG. 11 is an exploded view of a dispensing device according to the present invention illustrating the assembly of the component shown in FIG. 10A.

In order to insulate the battery compartment 68, an expanded polystyrene (EPS) insulation block 80 embraces the battery compartment 68. As shown in FIG. 11, the EPS insulation block 80 and the battery compartment 68 subassembly are positioned in the upper electrical compartment 26 of the upper housing 12 via ribs 25 and laser welded together.

Figure 12:
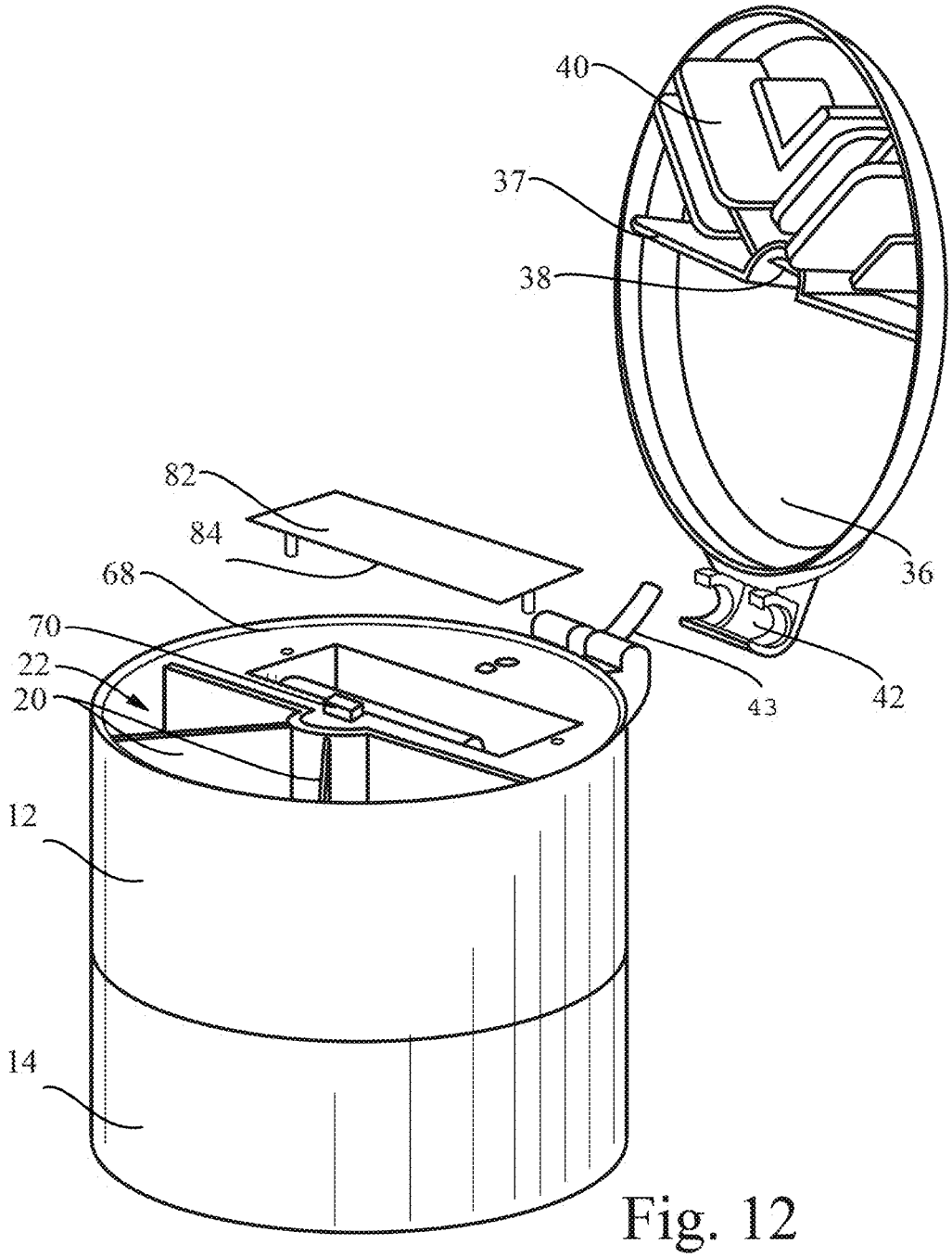
FIG. 12 is an isometric view of a dispensing device in accordance with the present invention.

The lid 36 is assembled on the hinge 42 of the upper housing 12 together with a stainless steel spring 43 which pushes the lid open (FIG. 12). The lid 36 can be a two component injection molded part from polypropylene with thermoplastic polyolefin injected gaskets 37. The snap hook 38 in the middle of the lid 36 clicks behind the solenoid snap hook 70 as can be seen in FIG. 12. The push ribs 40 push the refill downwards, onto the ribs 20 dividing the sections of the refill compartment 22 to separate the refill into individual sections.

The batteries 66 can be placed in the battery compartment 68 with a little piece of plastic between the contacts to prevent premature discharge prior to use. A small ribbon can be included in the battery compartment to facilitate battery replacement. The battery compartment 68 is closed with the battery compartment lid 82, which includes a EPDM gasket seal 84 to make sure the compartment 68 is watertight. The lid is secured to the battery compartment with screws.

The Refill

Figure 13:
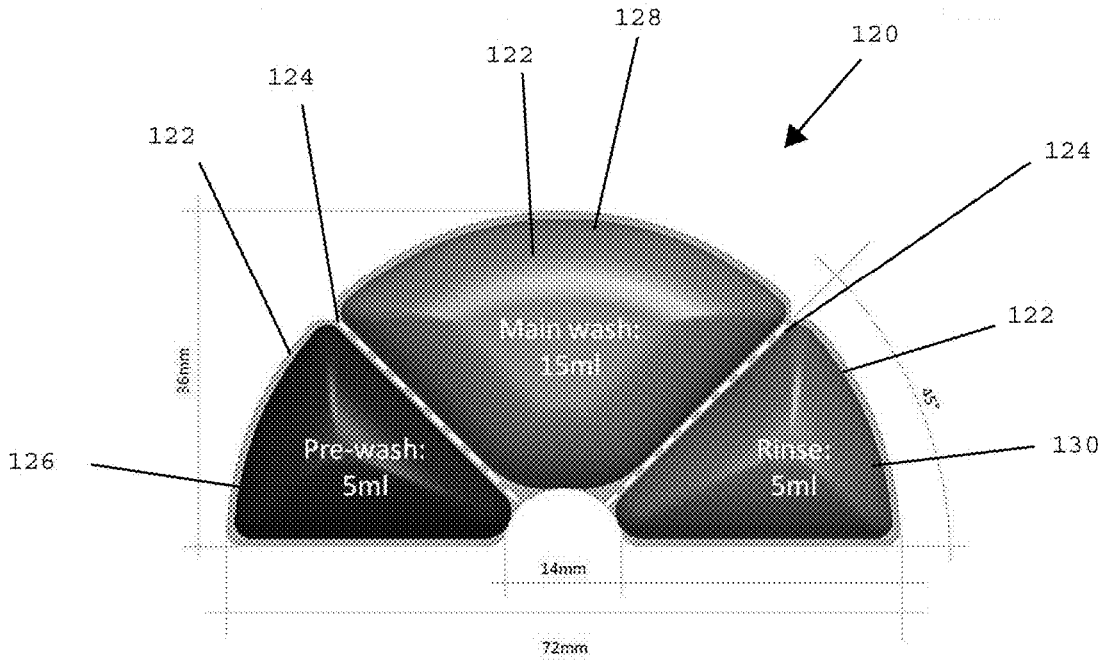
FIG. 13 is a plan view of a refill containing cleaning composition for the dispensing device according to the present invention.

The refill 120 containing cleaning compositions for the dispensing device 10 previously described is shown in FIG. 13. In order to prevent extra user steps for the consumer, such as removing and disposing of an empty refill and provide an eco friendly design, it is important that no waste is left in the refill compartment after the refill has been used. As a result, polyvinyl alcohol (PVA) film is used to cover the prewash, main wash and rinse cleaning compositions forming interconnected PVA pouch sections. PVA pouch sections are dissolvable in water and therefore, will fully dissolve inside the dishwasher. The dissolving time for the pouch sections can be adjusted by the thickness and the chemical composition of PVA film and water temperature.

The PVA cleaning composition sections 122 can be connected to each other by putting separable seams 124 in between the cleaning composition sections. The separable seams 124 can comprise detachable seams so that the sections can be easily separated during use. For instance, the separable seams 124 can be perforated to obtain a cutting or tear line for easy separation when placing the refill 120 in the dispensing device.

The refill can be formed in the shape of an arc ranging from about 90 degrees to about 180 degrees. The refill design shown in FIG. 13 is a half circle with an outside diameter of 72 mm. The prewash composition section 126, main wash composition section 128 and rinse composition section 130 are arranged in order with the main wash section 128 in the middle separating the prewash and rinse sections. The main wash section 128 is attached to the prewash section 126 and rinse section 130 on opposing sides by a perforated seal 124. The total volume of cleaning composition in the sections forming the refill 120 ranges from about 10 ml to about 80 ml per complete wash cycle. The subdivision per section and corresponding sub cycle is between 5 ml and 25 ml. For the embodiment shown in FIG. 13, the three cleaning composition sections contain 5 ml for the pre-wash section 126, 15 ml for the main wash section 128 and 5 ml for the rinse 130 resulting in a total cleaning composition dosage volume of 25 ml.

During use, the consumer places the refill 120 on top of the refill compartment 22 of the dispensing device 10 (shown in FIGS. 2 and 12) where push ribs 40 on the inside surface of the lid 36 force the refill 120 downwards into the refill compartment 22 as the lid is closed. The refill compartment 22 includes three sections divided by rib structures 20 which cut through the PVA seal 124, separating the sections 122 of the refill 120 from one another.

Regarding all numerical ranges disclosed herein, it should be understood that every maximum numerical limitation given throughout this specification includes every lower numerical limitation, as if such lower numerical limitations were expressly written herein. In addition, every minimum numerical limitation given throughout this specification will include every higher numerical limitation, as if such higher numerical limitations were expressly written herein. Further, every numerical range given throughout this specification will include every narrower numerical range that falls within such broader numerical range and will also encompass each individual number within the numerical range, as if such narrower numerical ranges and individual numbers were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A personalized cleaning composition dispensing device comprising an upper housing and a lower housing; the upper housing comprising a refill compartment and an upper electronics compartment, the lower housing comprising a dispensing compartment beneath the refill compartment and a lower electronics compartment, the personalized cleaning composition dispensing device comprising:

a. a printed circuit board disposed in the upper or the lower electronics compartment, the printed circuit board comprising a microprocessor and data storage unit linked to the microprocessor;

b. a plurality of sensors disposed in the upper or the lower electronics compartment and linked to the microprocessor;

c. a motor disposed in the upper or the lower electronics compartment and linked to the microprocessor; and d. a release mechanism disposed between the upper and lower housing separating the refill compartment from the dispensing compartment, the release mechanism is mechanically linked to the motor, wherein the microprocessor controls actuation of the release mechanism via the motor relative to readings from the plurality of sensors and selects either a pre-programmed product release algorithm or a modified product release algorithm based on wash cycle data stored in the data storage unit.

2. The personalized cleaning composition dispensing device of claim 1 further comprising a power source comprising a battery.

3. The personalized cleaning composition dispensing device of claim 1, wherein the plurality of sensors comprise a temperature sensor, and water flow sensor.

4. The personalized cleaning composition dispensing device of claim 3, wherein the water flow sensor comprises a capacitor.

5. The personalized cleaning composition dispensing device of claim 1 wherein the data storage unit stores wash cycle data measured by the plurality of sensors as a function of time during wash programs selected by a consumer.

6. The personalized cleaning composition dispensing device of claim 5 wherein the wash cycle data measured by the plurality of sensors as a function of time is compared to wash cycle data stored in the data storage unit to identify the wash program selected as either a new wash program or a repeated wash program.

7. The personalized cleaning composition dispensing device of claim 6 wherein the microprocessor selects either the modified product release algorithm based on data stored in the data storage unit for the repeated wash programmed or the pre-programmed product release algorithm for the new wash program.

8. The personalized cleaning composition dispensing device of claim 7 wherein the wash cycle data for the new wash cycle is stored in the data storage unit.

9. The personalized cleaning composition dispensing device of claim 1 wherein the release mechanism comprises a rotating disc.

10. The personalized cleaning composition dispensing device of claim 1 wherein the motor comprises a stepper motor.

11. The personalized cleaning composition dispensing device of claim 1, wherein the motor comprises a DC motor which controls the position of the release mechanism via a hall sensor disposed in the lower electronics compartment and a magnet disposed on the release mechanism.

12. The personalized cleaning composition dispensing device of claim 1 further comprising a bottom part attached to the lower housing closing the bottom electronics compartment.

* * * * *